US005872549A

United States Patent [19]

Huynh et al.

[11] Patent Number: 5,872,549

[45] Date of Patent: Feb. 16, 1999

[54] FEED NETWORK FOR QUADRIFILAR HELIX ANTENNA

[75] Inventors: Son H. Huynh, Gardena; Chun-Hong Chen, Torrance; Jack S. Mc Laren, San Pedro; Donnie H. Briscoe, Hawthorne, all of Calif.

[73] Assignee: TRW Inc., Redondo Beach, Calif.

[21] Appl. No.: 640,325

[22] Filed: Apr. 30, 1996

[51] Int. Cl.[6] ..... H01Q 1/36

[52] U.S. Cl. ..... 343/895; 343/702; 343/850

[58] Field of Search ..... 343/872, 702, 343/865, 895, 858, 850, 891, 830; 333/26; H01Q 1/36, 1/24

[56] References Cited

U.S. PATENT DOCUMENTS

| | | | |
|---|---|---|---|
| 4,012,744 | 3/1977 | Greiser | 343/895 |
| 4,608,574 | 8/1986 | Webster | 343/895 |
| 5,134,422 | 7/1992 | Auriol | 343/895 |
| 5,198,831 | 3/1993 | Burrell et al. | 343/895 |
| 5,346,300 | 9/1994 | Yamamoto et al. | 343/895 |
| 5,349,365 | 9/1994 | Ow et al. | 343/895 |
| 5,485,170 | 1/1996 | McCarrick | 343/895 |
| 5,534,882 | 7/1996 | Lopez | 343/891 |
| 5,581,268 | 12/1996 | Hirshfield | 343/853 |

*Primary Examiner*—Donald T. Hajec
*Assistant Examiner*—Tho Phan
*Attorney, Agent, or Firm*—Michael S. Yatsko; Ronald M. Goldman

[57] ABSTRACT

An antenna and antenna feed assembly for a communication handset is constructed as a unitary assembly in which each of the antenna and antenna feed, suitably a balun, conform to a cylindrical geometry and is small enough in size for handset applications.

2 Claims, 3 Drawing Sheets

FEED NETWORK FOR QUADRIFILAR HELIX ANTENNA

FIELD OF THE INVENTION

This invention relates to baluns and, more particularly, to a new integrally formed quadrifilar helix antenna and balun feed network combination small enough for handset application.

BACKGROUND

A key factor to the growth of present cellular telephone systems is the portable telephone's convenient small size and light weight. That allows the person to carry the portable telephone in a coat pocket, which is most convenient. As a consequence of that convenience and its recognized utility, the number of portable telephone subscribers continues to grow.

Various communications satellite systems under development, such as that system referred to as Odessey, are intended to provide improved wireless digital telephone communications for ground based mobile telephone subscribers, a term encompassing those who transport the telephone on their person. In those systems, a sufficient number of satellites in medium earth orbit MEO), suitably twelve in Odessey, are to provide communication coverage over a major portion of the earth. Using a self contained battery operated digital wireless portable telephone handset to communicate with those satellite communications systems, the telephone subscriber is expected to be able to contact or be contacted by others anywhere on earth.

Because the distance from the user's handset to the RF repeating equipment in the communications satellite is much greater than the analogous distance between a cellular user's handset to the telephone cellular repeater equipment, typically found nearby atop tall buildings, and because the transmission frequencies employed in the satellite system is significantly higher, the handset equipment used in the existing cellular system, specifically the antennas, cannot retain their structure and be scaled in size for use in such satellite systems. Among other things, the change requires different antenna technology.

Due to its superior performance compared to other types of antennas, the known stacked quadrifilar helix antenna (QHA), used earlier in the INMARSAT satellite system, has been proposed by others for use in the Odessey system. The quadrifilar helix antenna is composed of four identical helixes wound, equally spaced, on a cylindrical surface. For transmitting, the helices are fed with signals equal in amplitude and 0, −90, −180, and −270 degrees in relative phase to produce circularly polarized electromagnetic radiation (RF). That antenna provides a generally hemispherical radiation pattern.

A stacked quadrifilar helix antenna incorporates two such antennas, one located over the other along the same cylindrical axis. The upper antenna serves for transmitting RF energy at one frequency and the lower antenna for receiving RF energy at another frequency, which, for Odessey, are suitably of 1.618 GHz and 2.483 GHz, respectively, in the microwave frequency range.

Owing to the possible small size, light weight and circular polarization properties, apart from its feed network, that quadrifilar helix antenna appears attractive. However the antenna's helices are fed microwave energy by either a quadrature coupler or by a balun. A balun is a passive RF matching device that converts a transmission line carrying the transmit and/or receive signals, such as a coaxial cable, strip line or microstrip and the like, into a balanced feeder. At microwave frequencies, resonant transmission lengths in baluns act as wave traps and incorporated feed phase inverters. It is an equal power divider, in the case of transmitted microwaves, and an equal power combiner in the case of received microwaves, having perfect return loss at the input, no matter what kind of electrical impedance appears at the outputs. Although the foregoing balun feed network properly functions in the antenna combination, proving the technology's worth, a significant practical disadvantage to the present is that the feed system is large in physical size, larger than the size of the electronic equipment in the handset. The quadrature coupler also has that disadvantage.

Consequently, if used on a handset communicator, the handset unit could not be conveniently stowed in ones coat pocket, and, as a consequence, the commercial viability of the communication system appears implicitly threatened by a foreseeable inability to attract the interest of sufficient numbers of consumers to carry about an awkward device. That concern provides incentive for an antenna system that is small enough or an antenna feed that is small enough in size that makes practical a communicator package or handset that may be carried within ones coat pocket.

An object of the present invention, therefore, is to realize an antenna package for a handheld portable battery operated communication transceiver, a wireless telephone, into a small size, small enough to be "consumer friendly", allowing the consumer to conveniently carry the telephone on the person. An ancillary object is to provide the foregoing at low manufacturing cost while maintaining acceptable levels of RF performance. An additional object of the invention is to provide a new geometry for a microstrip balun structure. The present invention realizes those objectives.

SUMMARY OF THE INVENTION

Applicant's have discovered that a microstrip balun can be formed to the shape of a hollow cylindrical tube of a size that is suited to a communicator handset. As an additional aspect the present invention also combines a fractional turn quadrifilar helix antenna with a microstrip feed system, containing a balun and coupling sections, in a unitary assembly of cylindrical geometry; one formed together into a short cylindrical surface small enough in size for use on a communicator handset.

In one specific embodiment the elements are formed on a non-metallic dielectric tube of small diameter by using a flexible dielectric sheet and a wrap technique; in another by direct application to a dielectric tube, using a plating and laser etch technique. The balun defines a unique laminate structure that is essentially a two dimensional cylindrical surface, suitably curved in the shape of a hollow cylinder. The feed system is placed in line, end to end, with the conductors of an associated quadrifilar helix antenna.

The invention provides a physically compact light weight unitary assembly, essentially of the shape of a short rod that physically attaches to a transportable communications handset, suitably by an electrical connector.

The foregoing and additional objects and advantages of the invention together with the structure characteristic thereof, which was only briefly summarized in the foregoing passages, becomes more apparent to those skilled in the art upon reading the detailed description of a preferred embodiment, which follows in this specification, taken together with the illustration thereof presented in the accompanying drawings.

DETAILED DESCRIPTION OF THE PREFERRED EMBODIMENTS

Figure 1:
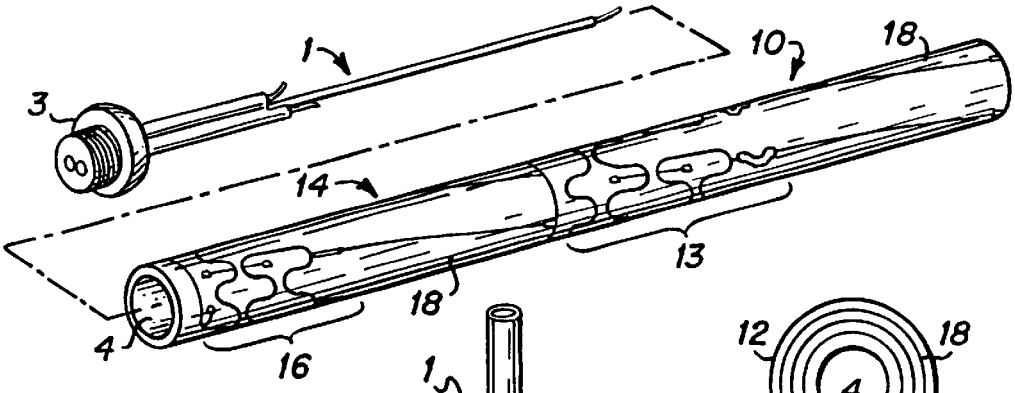
FIG. 1 illustrates an embodiment of the cylindrical shaped antenna and antenna feed assembly system in a perspective partially exploded view.
Figure 2:
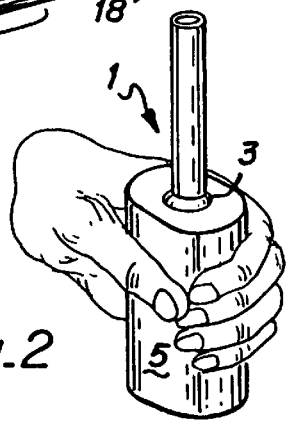
FIG. 2 is a pictorial view showing the embodiment of FIG. 1 in handset application.

The microwave antenna and feed system combination 1 forms a single piece three dimensional cylindrical structure or envelope as illustrated in the perspective view of FIG. 1. The assembly contains both a transmit antenna 10 and associated feed 12 for the transmit frequencies and a receive antenna 14 and associated feed 16 for the separate receive frequencies, which are of higher frequency, and represents a stacked antenna array. A multiple lead connector 3, shown in exploded view, contains the three electrical leads for connection to the respective input and output feed of the antennas and the common or ground connection. With the respective leads connected to the assembly, the threaded connector mechanically attaches to and supports the rigid assembly atop a handset communicator 5, such as generally pictorially illustrated in FIG. 2, by threading connector 3 into a mating threaded connector attached to the handset communicator.

Figure 3:
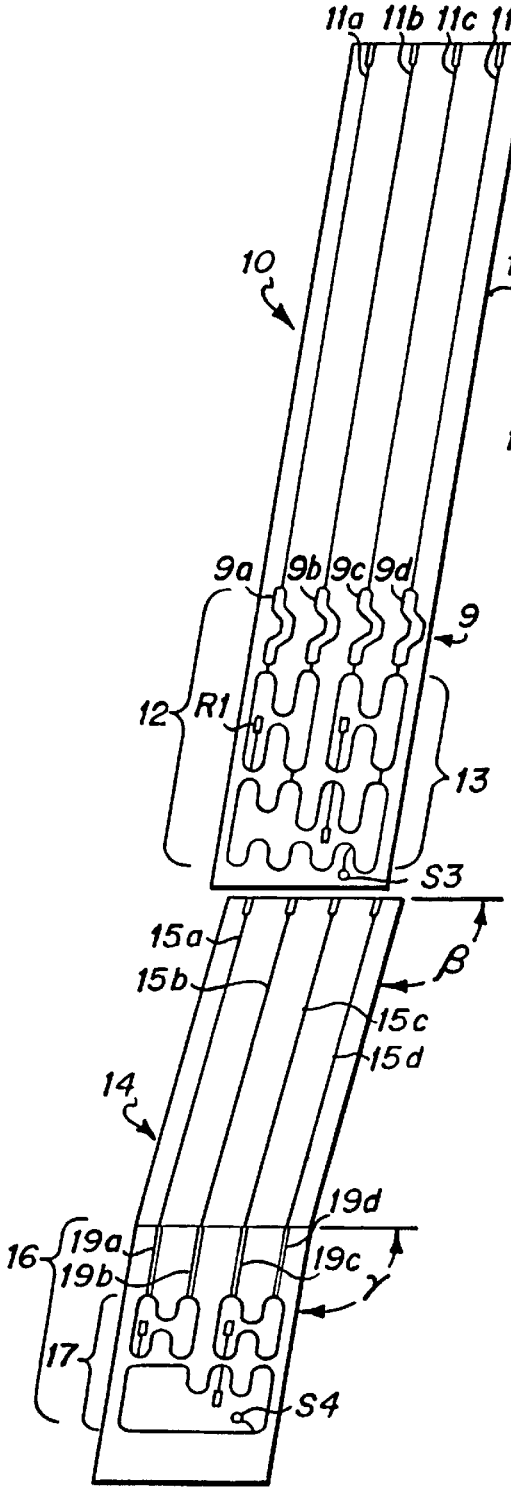
FIG. 3 is a two dimensional view or layout of the stacked quadrifilar helix antenna and antenna feed assembly of FIG. 1, unwrapped from the cylindrical form.

For better understanding of the structure, the antenna and feed is more precisely illustrated in FIG. 3, to which reference is made. The antenna and feed system combination is illustrated unwrapped from the cylinder shape and flattened, in an essentially two dimensional layout view. As later discussed, FIG. 3 is also the view of a subassembly used in one fabrication process in which the electrical elements are formed on a sheet of flexible electrical insulator with the requisite dielectric properties, such as Duroid, as a two dimensional laminate, is cut from that sheet and wrapped 360 degrees around and bonded to the outer surface of a hollow tube 4 of dielectric material.

The assembly of FIG. 3 includes a transmitting antenna 10, a feed system 12 for the transmitting antenna, a receiving antenna 14 and a feed system 16 for the receiving antenna. Transmitting antenna 10 is located vertically above the receiving antenna and thereby forms a stacked assembly. Feed system 12 includes a balun 13, comprised of the serpentine pattern of conductors, and a matching transformer 9 comprised of the four slightly looped leads. The feed system 16 for the receiving antenna includes a balun 17 and four matching conductors 19. The foregoing elements are formed of the conductors attached to a sheet or base of dielectric. In this layout, the transmit portion forms a parallelogram of base angle $\alpha$, while the receive portion forms a parallelogram of base angle $\beta$.

Antenna 10 contains four straight conductors, 11*a*, 11*b*, 11*c* and 11*d*, spaced evenly and parallel to one another at a slight angle $\alpha$ to the horizontal upper edge, attached or plated on the insulative sheet 18, as example a base layer of 3010 Duroid material having a thickness of 0.010 inches. As illustrated the distance between the right hand side of conductor 11*d* and right hand edge of the base 18 is the same as the distance between the left hand side of conductor 11*a* and the left hand edge of base layer 18; and the sum of those two distances is the same as that spacing between conductors 11*a* and 11*b*, 11*b* and 11*c* and so on. If one visualizes rewrapping the illustrated arrangement back into a cylinder by holding the horizontal upper end of the assembly in the figure at the flat end of a right cylindrical tube 4 that is essentially of a diameter equal to the lateral distance across layer 18 and wrapping same 360 degrees around the periphery to form a cylinder, allowing slight space for any bonding adhesive, one is able to visualize that the antenna's conductors are spaced evenly about the axis of the cylinder. And each conductor winds spirally about the tube, in total, defining a fractional turn, that is, one-half turn, quadrifilar helix antenna. When fed with microwave energy of frequency f supplied to each of the four inputs with the signal at each input being ninety degrees out of phase with adjacent inputs, the antenna emits microwave energy that is circularly polarized. The assembly, including antenna and antenna feeds, appears as a cylinder in profile as illustrated in FIG. 1 and to enlarged not to scale view in the section view of FIG. 4A.

Figure 4A:
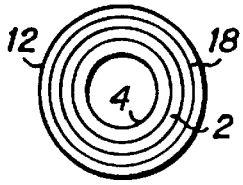
FIG. 4A is a section of FIG. 1 in an enlarged and not to scale view and FIG. 4B is a like section view of an alternative embodiment.
Figure 4B:
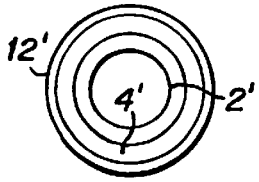

As shown in FIG. 4A the structure is a laminate in which the dielectric layer 18, carrying the balun's ground plane 2 on its bottom side and conductors, such as 12, on its upper surface, is bonded to a hollow dielectric tube 4. The same cylindrical configuration is retained in an alternative embodiment later herein described, the conductors 12' and 2' are bonded directly onto the outer and inner surfaces of the dielectric tube 2' as appears in the corresponding not to scale section view of FIG. 4B.

Again making reference to FIG. 3, Antenna 14 is likewise formed of four parallel straight conductors aligned at a different angle $\beta$ to the upper horizontal edge, 15*a*, 15*b*, 15*c* and 15*d*, formed on the insulative sheet or base 18 and in its cylindrical form also defines a one half turn quadrifilar helix antenna. The conductors are, however, shorter in length than the conductors in antenna 10, since antenna 14 is intended for operation at a higher frequency.

The feed system for antenna 10 contains four electrical leads, 9*a* through 9*d*, which are formed in a slight open loop. The leads connect the respective antenna stems 11*a* through 11*d* to the corresponding four outputs of balun 13. The leads supplies the microwave signal to the antennas at relative phases of 0, −90, −180, and −270 degrees.

A balun is a known device that converts a transmission line, such as coaxial cable and microstrip, into a balanced feeder. It is a passive electrical device. That is, it is used to match signals from an unbalanced transmission line to a balanced one, such as the four inputs in receive antenna 14 to a balanced transmission line, the single output, the single output from balun 17 to the external receiver circuits, later herein discussed. It is an equal power divider, in the case of transmitted microwaves, and an equal power combiner in the case of received microwaves, having perfect return loss at the input, no matter what kind of electrical impedance appears at the outputs.

Balun 13, considered first, appears as two "H" shaped figures overlying a third "Siamese" interconnected double "H" configuration, formed on the dielectric surface by metal conductors, and includes a conductive metal layer, the "back plane" surface, not visible in the figure, that underlies the foregoing "H" shapes, located on the underside of the electrically insulative dielectric base 18. It is appreciated that the complex geometric appearance of the balun structures is difficult to relate in words.

Figure 5:
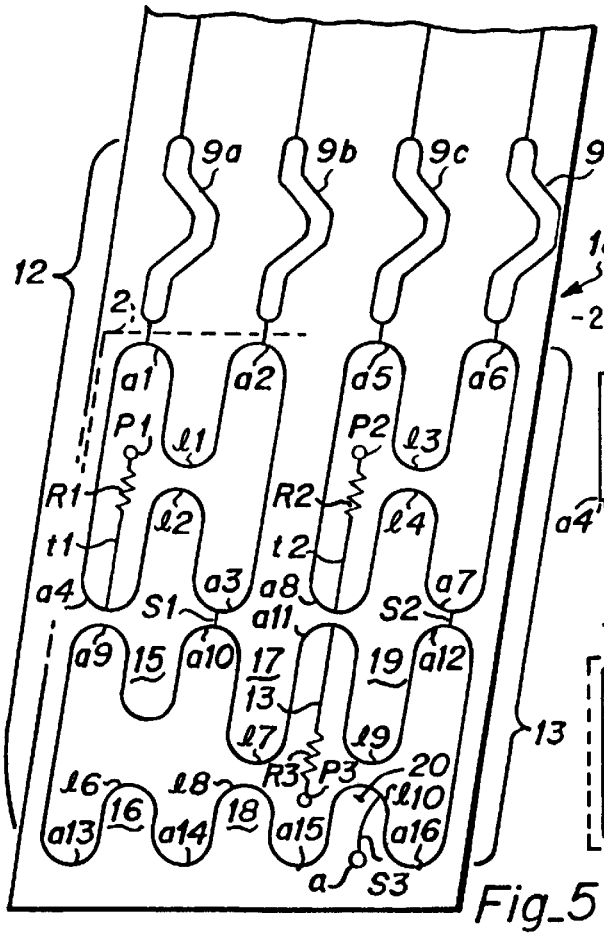
FIG. 5 illustrates a layout view of the transmit balun used in the embodiment of FIG. 1 drawn to enlarged scale and FIG. 6 is a corresponding layout of a conventional microstrip balun, presented to assist in describing the baluns in FIG. 1.

This balun is described in greater detail in FIG. 5, to which reference is made, in which the balun is illustrated in a larger scale. Considering the "H" figure to the upper left in balun 13, it is seen that the electrical conductor extends about in a recurrent path from an upper prominence or peak a1, an open loop 11 that faces downwardly and returns to another peak a2. From there the path extends downwardly a distance to an oppositely facing peak a3, another open loop 12, that is in line with the first mentioned loop, but oppositely facing, to still another or fourth peak a4. And from there the path extends straight in an upwardly direction, returning to the first peak a1. All of the peaks and turns, as shown are rounded. And peak a1 is in line with peak a4; and peak a2 is in line with peak a3. Further, from peak a4, on the bottom left side of the element, a straight conductor t1 extends to one end of a resistive termination, resistor R1; and the remaining end of that resistor element is connected via a plated through hole P1 through the dielectric layer to and in electrical contact with the metal layer on the underside of the dielectric layer 18. Each of the upper peaks, a1 and a2, serves as a respective output to the balun and is connected to looped conductor matching sections 9*a* and 9*b*, respectively, and through those matching sections connects to respective antenna stems 11*a* and 11*b*. As later described, the distance between each peak along each branch of the path represents one quarter wavelength at the frequency of the signal for which the antenna is intended to be utilized.

The second "H" appearing to the right in the section is identical in structure and geometry with that of the previously described section. Thus this portion contains a conductor path containing upper peaks a5 and a6, downwardly formed open loop 13 therebetween, oppositely extending peaks a7 and a8, and upwardly extending open loop 14. The section further contains a conductor t2 that extends from peak a8 to one end of resistive termination R2, the latter of which has its remaining end connected through a plated through hole P2 in the dielectric base 18 to the underlying metal layer 2, only partially illustrated by dash lines, that forms the balun's ground plane. This portion is located spaced to the right and side by side with the other balun element and is positioned at the same vertical height. Each of the upper peaks, a5 and a6, serves as a respective output to balun 13 and is connected to the remaining two looped conductor matching sections 9*c* and 9*d*, respectively, and through those matching sections connect to the remaining antenna stems 11*c* and 11*c*.

The conductor path located below the two H shaped paths, resembling a double H in appearance, describes a recurrent serpentine path. This serpentine path contains three open loops facing downward 15, 17 and 19, located between four peaks a9, a10, a11 and a12, located on the upper side, and three open loops 16, 18 and 110, facing upwardly, located between the four downwardly facing peaks a13, a14, a15 and a16. Each of the latter loops are shorter in depth than loops 15, 17 and 19; and loops 17 and 19 are of the same depth, and deeper than loop 15. The peaks and loops in this section are located in line with one another. Moreover, the peaks a9 and a13 are in line also with the peaks a1 and a4 of the H section on the left; peaks a10 and a14 are in line also with the peaks a2 and a3 of that same H section; peaks a11 and a15 are also in line with peaks a5 and a8 of the other H section on the right side; and peaks a12 and a16 are also in line with peaks a6 and a7 of that right side H section. The lines referred to as in line is a line which is angled from the horizontal in FIG. 1 by the same angle, $\alpha$, shown for the conductor lines 11*a* to 11*d* of antenna 10.

Further, from peak all in the serpentine path, a straight conductor t3 exends to one end of a resistive termination, resistor R3; and the remaining end of that resistor element is connected via a plated through hole P3 through the dielectric layer to and in electrical contact with the metal layer on the underside of the dielectric layer 18. A short length of conductor S1 connects peak a10 of the double H section to peak a3 in the H section to the left; a like short length of conductor S2 connects peak a12 of the double H section to peak a7 in the right H section. An input conductor S3 is connected at one end to a portion of loop $l_{10}$ in the double H section; at its other end the lead is connected to the center conductor, the hot lead, of the coaxial line to the transmitter, enabling the RF to be coupled to the balun. This double H portion of the balun serves as a "magic T" or "rat race" microwave device. Each balun includes a ground plane, which is a metal layer that unlies the foregoing balun circuit elements and covers the entire space occupied by the balun's circuit elements. The metal layer 2, only partially illustrated in FIG. 5 by dash lines, is spaced from the circuit elements by the dielectric material 18. In the layout view that metal layer comprises a parallelogram in shape and, thus, is not necessary of separate illustration.

The loops in each of the foregoing sections are seen to provide a means to physically lengthen the spacing distance between portions of the circuit within a confined region, ensuring that the distance is of the requisite fractional number of line wavelengths, measured at the frequency at which the balun is designed to operate. The distance between output a6 and a5 in the right H section, as example, must be at relative phase of zero and one quarter wavelength, respectively. However in the limited space available on the circumference of the cylindrical surface, a straight circumferential conductor between those two points would be too short at the design frequency, 1.6186 GHZ in the example given. The loop serves to increase that distance to the proper length. Thus, the greater the depth of the loop, the greater the distance in wavelengths between the two adjacent peaks. This same consideration follows in employing each of the loops in the balun section in the transmit balun and also in the receive balun 17.

Figure 6:
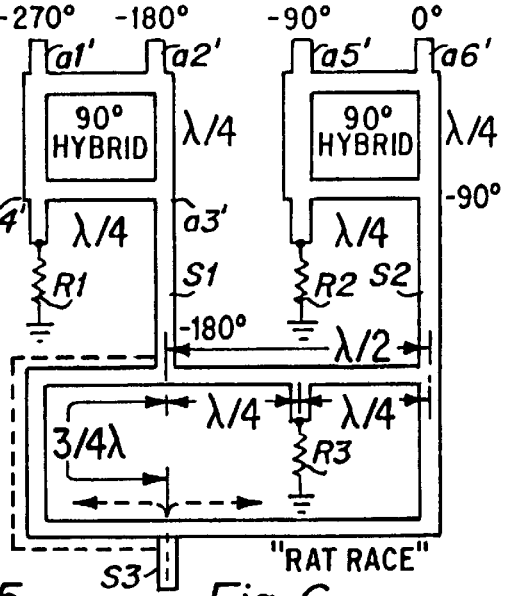

The rationale behind the foregoing design is better illustrated in FIG. 6 to which reference is made. In this figure the upper conductor structure of a more conventional flat balun that is not constrained in dimension is presented to illustrate the principal. For convenience corresponding circuit points are given the same number used in the prior figure and are primed. In this figure the routing of the microwave signal is represented by a dash line and the pertinent distances are expressed in wavelengths. As example, the distance between a5' and a6' is one quarter wavelength. It is understood that a balun of the foregoing pattern is not acceptable, even if formed into a cylinder, as the size of the cylinder attained would be too large in size for handset use.

Returning to FIG. 3, the feed system for receive antenna 14 contains four electrical leads each defining impedance transformers, 19*a* through 19*d*. The leads connect the respective antenna stems 15*a* through 15*d* of the receive antenna 15 to the corresponding four inputs of balun 17. The leads supply the received circularly polarized microwave signal from the antenna at relative phases of 0, −90, −180, and −270 degrees to the balun, which converts that circularly polarized signal to a linear one suitable for transmission on a coaxial line to the external microwave receiver circuits.

Reference is again made to the receive balun 17. It is seen that the two H shaped sections formed by the electrical conductors and the underlying conductor formed serpentine section is similarly arranged to that of balun 13, earlier described, with the two H sections aligned and side by side and the serpentine section is located below the two H sections. However the depth of the loops in the H section is shorter than the corresponding portion of the transmit balun; and the length of the straight sides is shorter. Moreover, the number of loops in the serpentine section are fewer than the corresponding section in the former. This is so since the receive balun is designed for operation at a higher frequency than the transmit balun, 2.483 GHZ in the example given, hence the wavelength of the received signals is shorter than the transmit signals. Being shorter, those signals better fit within the space constraints imposed by the cylindrical surface and thereby require a lesser amount of indirect routing to attain the required fractional wavelength spacing. A conductor s4 connects the lower rightcorner of the lower serpentine section to an output where it is connected to the lead of the receive transmission line.

In a first described embodiment, the foregoing elements are formed, using conventional printed circuit plating and etching technique in multiple layers as a laminate, on a single sheet of flexible electrically insulative material 18, suitably that marketed by the Duroid company as "Duroid", 10 mils thick. Due to its characteristic flexibility, the dielectric sheet and the conductors plated thereon may be curved or pressed as a unitary assembly into the shape of a cylinder as was illustrated in the section view of FIG. 4A.

Figure 7A:
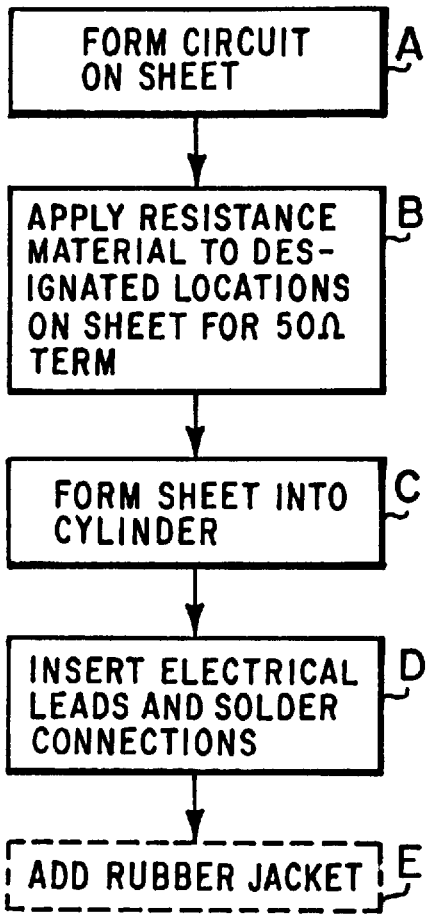
FIGS. 7A, 7B, 7C and 7D illustrate various processes and portions of processes, used to construct the various embodiments of the antenna and feed assembly.
Figure 7B:
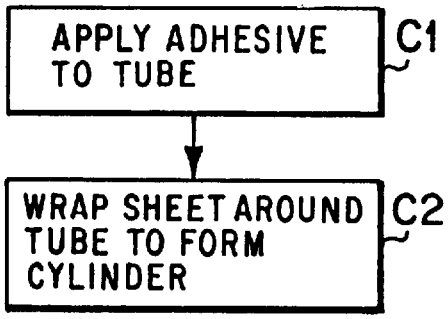

The antenna and feed system assembly may be formed according to the printed circuit technique earlier described using a separate flexible circuit board that is wrapped around and bonded to a cylinder. As illustrated in FIG. 7A, the circuit patterns are formed on the dielectric sheet, A, which includes forming the parallelogram shaped metal layer for the balun's ground plane on one side of the sheet, resistance material, suitably carbon, is screened onto the sheets at the designated locations in FIG. 3, as represented at B; the sheet is formed into a cylinder as represented at C. This step has a number of alternatives, one of which is considered. Given a dielectric tube as a support in which passages have been drilled through or otherwise formed through the tube wall at positions corresponding to those for the input, output and ground leads, the step C in FIG. 7A would then include the steps of applying an adhesive to the outer cylindrical surface of the dielectric tube, as represented in FIG. 7B as C1, carefully aligning the passages through the sheet with those drilled in the wall of the tube, and wrapping the sheet around the tube, as represented at C2, whereby the sheet adheres to the cylindrical tube. Returning to FIG. 7A, the electrical leads are inserted axially within the tube, inserted, into the corresponding openings in the tube wall and in the dielectric sheet and soldered in place; and the connector is fastened to the tube end, represented at D. If desired, a rubber jacket or other suitable protective covering may be added to cover the antenna assembly as represented at E.

As specific example a hollow tube of approximately 7.938 mm (0.3125 inches) in outer diameter and 254 mm (10.00 inches) in length and inner diameter of 7.62 mm (0.300 inches) inner diameter. Those tubes found acceptable for use in the foregoing combination include: a G10 glass epoxy tube as marketed by Vanderveer; a polycarbonate tube as marketed by U.S. Plastics Corp; For injection mold tube formation, a Altum 2312 polyetherimide marketed by General Electric and a polycrysulfone.

Figure 7C:
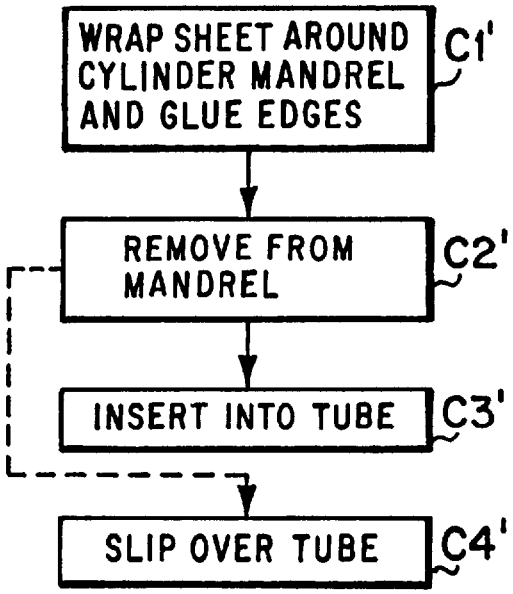

Another alternative construction technique at step C in FIG. 7A is, as represented in FIG. 7C, to first form the two dimensional surface of FIG. 3 into a cylinder and then place that cylinder within a rod like hollow tube, having a slightly larger inner diameter than the outer diameter of the formed tube. This is accomplished, as represented at C1' by forming the conductor plated dielectric sheet subassembly about a cylindrical mandrel and joining the edges together to hold the cylindrical shape. The cylinder is then removed from the mandrel, as at C2', the coaxial line leads are inserted and soldered in place and connector mounted in place, and the formed cylinder assembly is inserted into the hollow of the tube as at C3', abutting the inner cylindrical surface. The tube serves as a rigid or stiff support for the more fragile antenna assembly and physically protects that assembly from inadverant damage by the handset user.

In a still further alternative to the foregoing technique of FIG. 7C, the two dimensional surface of FIG. 3 is placed over the outer cylindrical surface of the tube having a slightly smaller outer diameter than the inner diameter of the formed tube, as represented at C4'. This is accomplished by forming the conductor plated dielectric sheet and resistance screened subassembly about a cylindrical mandrel and joining the edges together to hold the cylindrical shape. The cylinder is then removed from the mandrel. The hollow tube must have the electrical lead openings, corresponding to those described in the illustration of FIG. 2 drilled through the side wall. The formed cylindrical assembly is then slide coaxially onto the tube, and oriented so that the electrical lead openings in the tube are aligned with those in the cylindrical subassembly, the coaxial line leads are inserted into the tube and into the respective openings in the outer cylinder and are soldered in place and the connector mounted in place.

Figure 7D:
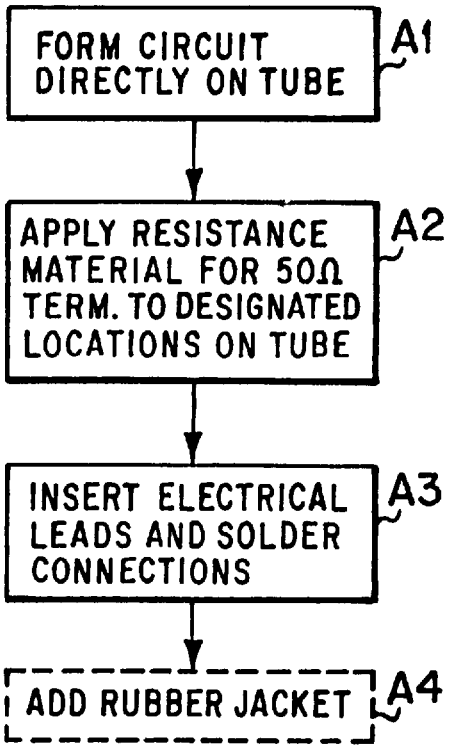

Alternatively, in a still further process, the antenna may be formed directly upon a molded non-metallic cylinder using alternative cutting and/or machining technique known in the circuit board industry as represented in FIG. 7D. In the latter, as represented in A1, one plates the inner and outer surfaces of a hollow molded plastic tube having the requisite length and diameter with electrically conductive material, such as copper. Applying a protective coat to the plating on the outer surface, one etches off the portion of the inner surface, leaving only the regions that serve as the conductive back plane surfaces for the baluns. Having the requisite image of the conductors on the outer surface within the memory of a laser cutting machine, a known machining apparatus, the tube is then mounted in the laser cutting machine.

The laser cutting machine then removes the unwanted conductive material from the outer surface, vaporizing that metal, leaving only the desired conductors. The appropriate passages are drilled radially through the tube wall at the appropriate positions. In that way, the antenna and feed assembly is directly formed on the cylindrical surface, eliminating the need for forming same on a flat sheet and wrapping as in the first technique. The resistance material is screen on the tube at the pertinent locations as at A2 and the conductors to the external circuits are soldered into place as represented at A3. The entire assembly may be jacketed, if desired, as at A4.

It is appreciated that in the practice of the invention the foregoing assembly is not required to contain both a transmit antenna and a receive antenna; it may contain one or the other or it may contain dual transmit antennas or dual receive antennas, all of which fall within the scope of the present invention. It is further appreciated that each of the transmitting antenna and associated feed balun and the receiving antenna and its associated feed balun may, alternatively, be formed separately, on separate sheets of Duroid. In such alternative technique, each antenna and associated balun is then separately fastened to or fabricated upon the cylindrical support tube. The resultant product is the same as before.

The formation of the balun into a cylindrical shape, specifically a complete 360 degree cylindrical surface, at first impression would not appear to pose difficulty, but only if unlimited space is available. Yet if given unlimited space, one first recognizes the absence of incentive or reason to make any change. However, accepting the applicant's motive to form the balun in a cylindrical shape, and given unlimited space at first, one might first simply employ a flexible base and shape the microstrip balun into a cylinder. A large cylinder results. One readily appreciates that a balun for a handset communicator cannot as a practical measure be as large in diameter as a pillbox. Instead, the rod like antenna should be as short in length and as small in diameter as is possible, while retaining acceptable radiation performance characteristics.

In the specific example given for the construction of one embodiment of the invention, the baluns are cylindrically formed about a hollow tube of approximately 7.9395 mm ±0.025 mm (0.3125 inches ±0.0010 inch) in outer diameter, an inner diameter of 7.62 mm (0.300 inches) and 254 mm (10.00 inches) in length. This provides a dimensional constraint limiting the circumferential length of the balun to that of essentially the outer diameter of the rod to $\pi$ multiplied by the diameter or $\pi$ 24.94 mm (0.9817 inches). Thus the lateral length of the surface to be wrapped around the tube, allowing some additional space for an adhesive layer, is 26.533 mm (1.0446 inches) and the balun for the antenna is formed within that length or less.

The foregoing requires serendipitous selection of a combination of three factors: First, the dielectric constant of the material on which the balun is formed, that is the material located between the backplane or ground layer and the configured conductors spaced above that backplane. In the case of the wrap around construction in FIG. 1, this is the material of the Duroid sheet; in the embodiment in which the balun is formed directly upon a dielectric tube, by a plate and laser etch technique, the material is that of the tube. Second, is the thickness of the material. The thickness of the material has influence on both the available width for the circuit conductors and the layering. Third, the layout of the conductors, which encompasses both the width of conductor portions in the circuit conductors and the routing of those conductors to define a distance of the proper wavelength. As reference to the technical literature on microwave transmission lines makes known, the foregoing two factors influence the resultant electrical characteristics of the transmission line, including phase velocity, and hence the "in the line wavelength" determined for a signal of a particular frequency in contrast to the signals greater "free space" wavelength, and characteristic line impedance.

Through trial and error aided by computer simulations using the available equations from the technical literature, it is found that a Duroid sheet, which possesses a dielectric constant of 10.0 plus or minus 0.25, and is of 0.254 mm (ten mils) in thickness permits the layout of conductors for the balun illustrated in FIG. 1 within the width of 26.53 mm (1.0446 inches), allowing the balun to be wrapped one turn about the support rod.

For embodiments in which the conductors are formed directly onto the tube, using the plate and laser etch process described, tubes may be fabricated of Duroid material, Arlon material or Ceramic (Alumina), all of which can possess dielectric constants of about 10, and that tube should also be of a wall thickness of about ten mils. That allows formation of embodiments having the appearance of the balun conductor layout used with the wrap around version of FIGS. 1 and 3.

Figure 8:
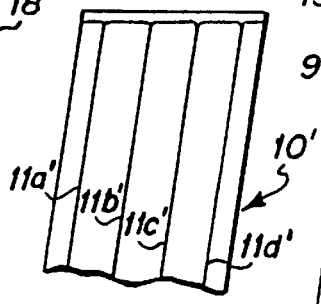
FIG. 8 is a partial layout view of a second embodiment of antenna and antenna feed system containing end shorted helices.

The antennas in the foregoing assembly are not limited to the style used in the embodiment of FIG. 3. Each spiral conductor in the quadrifilar helix antenna in the foregoing embodiment contains a free or open end, as variously termed. However, as is known, alternative versions of that type antenna may contain an electrically shorted end, that is, a conductor formed in a ring or circle, connected to the remote end of each of the four conductor convolutes in the antenna, such as illustrated in the partial layout of FIG. 8. That shorted end is located at one half wavelength, that is, "in the line" wavelength, from the opposite end, or multiples thereof. Such alternative construction produces different radiation characteristics than the antenna illustrated in FIGS. 1–4, which, in some instances may be preferred. It is recognized that the foregoing alternative construction comes within the scope of the present invention.

Figure 9:
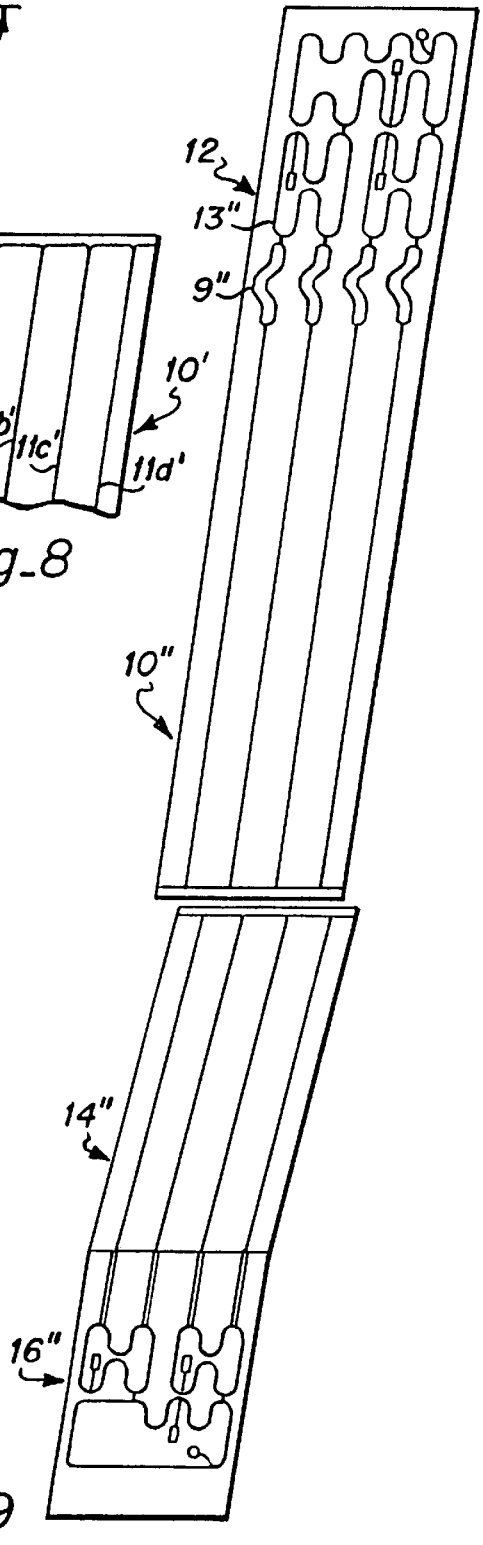
FIG. 9 is a layout view of still another embodiment of the invention.

Moreover, the invention is not limited to location of the antenna feed used in the embodiment of FIGS. 1 and 3, which are seen to define a center fed transmitting antenna and a bottom fed receiving antenna. Other known variations for feeding the antennas are conventional to quadrifilar helix antennas and also fall within the scope of the present invention. As example, such alternatives include a top feed for the transmit antenna. FIG. 9 presents a layout for a top fed antenna, which corresponds to the antenna layout of FIG. 3. The bottom fed transmit antenna construction, however, is preferred. With the balun located on top, it is found that the radiation characteristic of the helix antenna is not as desirable. It is believed that the balun interferes with the radiating qualities of the helices.

It is believed that the foregoing description of the preferred embodiments of the invention is sufficient in detail to enable one skilled in the art to make and use the invention. However, it is expressly understood that the detail of the elements presented for the foregoing purposes is not intended to limit the scope of the invention, in as much as equivalents to those elements and other modifications thereof, all of which come within the scope of the invention, will become apparent to those skilled in the art upon reading this specification. Thus the invention is to be broadly construed within the full scope of the appended claims.

What is claimed is:

1. A unitary antenna and antenna feed assembly for a handset communication device comprising:

a small diameter elongate cylindrical envelope, said cylindrical envelope containing: a first balanced quadrifilar helix antenna; and a first balun for coupling microwave energy between said first balanced quadrifilar helix antenna and an external microwave transmission line, each of said first balanced quadrifilar helix antenna and said first balun being of a shape that conforms to said cylindrical envelope;

said balanced quadrifilar helix antenna including first, second, third and fourth antenna chords; and wherein said first balun comprises:

a first meandering closed line, said first meandering closed line being closed upon itself and defining in appearance an outline of the English letter "H";

a second meandering closed line, said second meandering closed line being closed upon itself and defining in appearance an outline of the English capital letter "H";

said first and second meandering closed lines being substantially identical in size and being positioned in spaced side by side relationship;

a ground plane member;

first resistor means;

first lead means connected to a first predetermined position on said first meandering line;

said second resistor means connected between an end of said first lead means and said ground plane member;

second resistor means;

second lead means connected to a first predetermined position on said second meandering line;

said second resistor means connected between an end of said second lead means and said ground plane member;

first coupling lead means connected to a second predetermined position on said first meandering line for providing an electrical path to a first chord of said quadrifilar antenna and second coupling lead means connected to a third predetermined position on said first meandering line for providing an electrical path to a second chord of said quadrifilar antenna;

third coupling lead means connected to a second predetermined position on said second meandering line for providing an electrical path to a third chord of said quadrifilar antenna and fourth coupling lead means connected to a third predetermined position on said second meandering line for providing an electrical path to a fourth chord of said quadrifilar antenna;

a third meandering closed line, said third meandering closed line being closed upon itself; said third meandering closed line being positioned adjacent and axially spaced from said first and second meandering lines;

first coupling lead means connected to a first predetermined position on said third meandering closed line for coupling said third meandering closed line to an external transmission line;

third resistor means;

third lead means connected to a second predetermined position on said third meandering closed line;

said third resistor means connected between an end of said third lead means and said ground plane member;

first bridging lead means for bridging a fourth predetermined position on said first meandering closed line and a third predetermined position on said third meandering closed line; and second bridging lead means for bridging a fourth predetermined position on said second meandering line and a fourth predetermined position on said third meandering line.

2. The invention as defined in claim 1, wherein said third meandering closed line further comprises in appearance an outline of two copies of the English capital letter "H" that are connected together by a bridge.

* * * * *